US010851534B2

(12) United States Patent
Hetzler et al.

(10) Patent No.: US 10,851,534 B2
(45) Date of Patent: Dec. 1, 2020

(54) WALL HUNG TOILET ASSEMBLY WITH A SLOPED GASKET

(71) Applicant: Watts Regulator Co., North Andover, MA (US)

(72) Inventors: Roy Hetzler, Hendersonville, NC (US); Gary A. Hodge, Rutherfordton, NC (US)

(73) Assignee: Watts Regulator Co., North Andover, MA (US)

( * ) Notice: Subject to any disclaimer, the term of this patent is extended or adjusted under 35 U.S.C. 154(b) by 77 days.

(21) Appl. No.: 16/362,181

(22) Filed: Mar. 22, 2019

(65) Prior Publication Data

US 2019/0316337 A1 Oct. 17, 2019

Related U.S. Application Data

(60) Provisional application No. 62/656,567, filed on Apr. 12, 2018.

(51) Int. Cl.
*E03D 11/14* (2006.01)
*E03D 1/26* (2006.01)

(52) U.S. Cl.
CPC ..... *E03D 11/14* (2013.01); *E03D 1/26* (2013.01)

(58) Field of Classification Search
CPC ..... E03D 11/14; E03D 1/26
USPC ..... 4/252.1–252.5
See application file for complete search history.

(56) References Cited

U.S. PATENT DOCUMENTS

| | | | |
|---|---|---|---|
| 2,591,060 | A | 4/1952 | Garretson |
| 3,078,477 | A | 2/1963 | Schmid et al. |
| 3,686,695 | A | 8/1972 | Mielback et al. |
| 3,732,582 | A | 5/1973 | Mielbeck et al. |
| 4,058,859 | A | 11/1977 | Arrowood |
| 4,108,477 | A | 8/1978 | Morris |
| 4,979,239 | A | 12/1990 | Klein et al. |
| 6,301,838 | B1 | 10/2001 | Hall |
| 6,928,669 | B2 | 8/2005 | Akin |
| 6,979,027 | B2 | 12/2005 | Hetzler et al. |
| 7,571,497 | B2 | 8/2009 | Hetzler et al. |
| 8,141,177 | B1 | 3/2012 | Mojacka et al. |
| 8,505,124 | B2 | 8/2013 | Eichler et al. |
| 8,544,121 | B1 | 10/2013 | Mojacka et al. |
| 8,657,343 | B2 | 2/2014 | Rodenberg et al. |
| 9,464,426 | B1 | 10/2016 | Schaetzke et al. |
| 2016/0090726 | A1 | 3/2016 | Verdecchia et al. |

*Primary Examiner* — Tuan N Nguyen
(74) *Attorney, Agent, or Firm* — Burns & Levinson, LLP; George N. Chaclas; Paul D. Sorkin

(57) ABSTRACT

A toilet system has a connector that defines a cylindrical aperture, with a threaded interior surface, around a central axis and that is configured for fixation to a support structure. A cylindrical waste pipe is elongated along the central axis and has a plurality of spaced ribs extending from an exterior surface. A ring-shaped gasket is positioned around the central axis and has a plurality of interior voids, each void corresponding to, and configured to, receive one of the spaced ribs. Further, the ring-shaped gasket has a threaded exterior surface, that slopes toward the central axis, and which is configured for engagement with the threaded interior surface of the connector.

19 Claims, 7 Drawing Sheets

WALL HUNG TOILET ASSEMBLY WITH A SLOPED GASKET

RELATED APPLICATION

This application is a non-provisional application claiming priority from U.S. provisional patent application Ser. No. 62/656,567, filed Apr. 12, 2018 and entitled "Wall Hung Toilet Assembly With A Sloped Gasket," the entire contents of which are incorporated by reference herein for all purposes.

FIELD OF THE INVENTION

The subject disclosure relates to wall hung toilet technology, and more particularly, to gaskets for wall hung toilets.

BACKGROUND

Many toilets are arranged to connect to a drain through the floor of the room. Wall hung toilets, which are widely used in certain circumstances, connect to a drain pipe through a wall rather than through the floor. A wall hung toilet connector facilitates attachment of a wall hung toilet to a waste pipe. A typical connector supports the toilet off the floor and facilitates a connection between a waste pipe coupled to the toilet bowl and a drain pipe which carries wastewater out of the system.

For many reasons, including sanitary concerns, it is important that strong, tight seals are made along the wastewater transmission line. Given that the toilet is connected to the drain pipe horizontally, it can be particularly difficult to ensure an effective seal between the waste pipe and the connector. Further, it can be difficult to make a good seal while also setting up the toilet in a time efficient manner. For example, commercial buildings often require a large number of wall hung toilets, so it is important that the toilets can be set up quickly without sacrificing quality.

SUMMARY

In light of the needs described above, in at least one aspect, there is a need for an apparatus and method for installing a wall hung toilet expeditiously while still ensuring effective seals for the transmission of wastewater to a drain pipe.

In at least one aspect, the subject technology relates to a toilet system having a connector configured for fixation to a support structure. The connector defines a cylindrical aperture around a central axis. The cylindrical aperture has a threaded interior surface. A cylindrical waste pipe is elongated along the central axis and has a plurality of spaced ribs extending from an exterior surface. A ring-shaped gasket is positioned around the central axis. The ring-shaped gasket has a plurality of interior voids each corresponding to, and configured to, receive one of the spaced ribs. A threaded exterior surface of the ring-shaped gasket is configured for engagement with the threaded interior surface of the connector. The threaded exterior surface slopes toward the central axis.

In at least one aspect, the subject technology relates to a toilet system having a connector configured for fixation to a support structure. The connector includes a flange defining a cylindrical aperture with a threaded interior surface around a central axis. The threaded interior surface slopes toward the central axis from a wide side of the flange to a narrow side of the flange. A cylindrical waste pipe is elongated along the central axis and has a first open end configured to form a fluid connection with a toilet and a second open end. A plurality of spaced ribs extend from an exterior surface of the waste pipe adjacent to the second open end. A ring-shaped gasket is positioned around the central axis. The ring-shaped gasket has a plurality of interior voids each corresponding to, and configured to, receive one of the spaced ribs. Engagement between the spaced ribs and interior voids forces the ring-shaped gasket to rotate around the central axis in response to rotation of the waste pipe around the central axis. The ring-shaped gasket also has a threaded exterior surface configured for engagement with the threaded interior surface of the flange, the threaded exterior surface sloping toward the central axis from a wide end to a narrow end. The toilet system is configured such that when the narrow end of the ring-shaped gasket is positioned within the wide side of the connector, rotation of the ring-shaped gasket around the central axis tightens a seal formed between the threaded interior surface of the aperture and the threaded exterior surface of the ring-shaped gasket.

In at least some embodiments, the threaded exterior surface slopes toward the central axis at an angle of about 10°. In some cases, the threaded exterior surface can slope toward the central axis at an angle of between 5° and 15°. In some embodiments, the toilet system includes a pipe chase configured for attachment to the connector around the cylindrical aperture. The system can further include a chase gasket configured to couple the pipe chase to the connector. In some embodiments, a plurality of screws are configured to attach to the connector around the cylindrical aperture.

In some embodiments, the ring-shaped gasket is of a first material of a first durometer and the ring-shaped gasket includes a ring insert structurally reinforcing the interior voids. The ring insert can then be of a second material of a higher durometer than the first material. The cylindrical waste pipe can be elongated along the central axis. The cylindrical waste pipe can have a first open end configured to form a fluid connection with a toilet a second open end. In some embodiments, the connector includes a flange and the cylindrical aperture is defined by the flange, threaded interior surface forming an interior surface of the flange. In some cases, threaded interior surface slopes toward the central axis from a wide side of the flange to a narrow side of the flange. The threaded exterior surface of the ring-shaped gasket can slope from a wide end of the ring-shaped gasket to a narrow end of the ring-shaped gasket. The narrow end of the ring-shaped gasket can have a smaller outer diameter than an inner diameter of the wide side of the flange. The wide end of the ring-shaped gasket can have a larger outer diameter than an inner diameter of the narrow side of the flange, preventing the ring-shaped gasket from passing entirely through the connector.

In some embodiments the cylindrical waste pipe includes at least two gaps along an interior diameter of the waste pipe. Each gap has an opposing gap at an opposite position along the interior diameter and the gaps are configured to receive a fixed member of a carrier nipple tool for rotation of the cylindrical waste pipe. In some cases, the cylindrical waste pipe includes exactly two opposing gaps.

BRIEF DESCRIPTION OF THE DRAWINGS

Various aspects of the disclosure are discussed below with reference to the accompanying figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, not every component may be labeled in every drawing. The Figures are provided for the purposes of illustration and explanation and are not intended as a definition of the limits of the disclosure. In the Figures.

DETAILED DESCRIPTION

Figure 1:
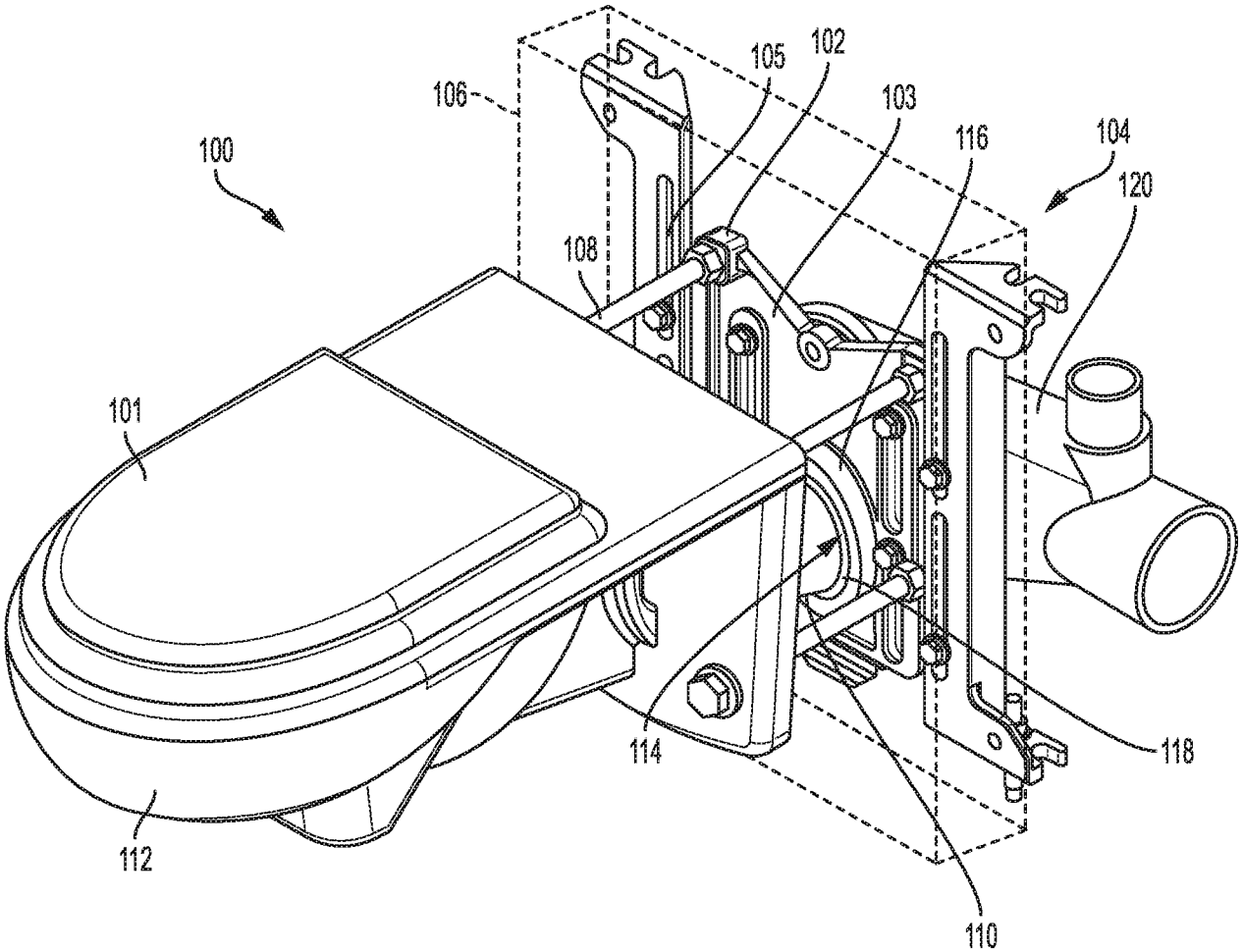
FIG. 1 is a perspective view of a wall hung toilet system.

This application is a non-provisional application claiming priority from U.S. provisional patent application Ser. No. 62/656,567, filed Apr. 12, 2018 and entitled "Wall Hung Toilet Assembly With A Sloped Gasket," the entire contents of which are incorporated by reference herein for all purposes.

The subject technology overcomes many of the prior art problems associated with wall hung toilets. In brief summary, the subject technology provides a gasket that more effectively seals the waste pipe of a wall hung toilet to a connector. Other advantages and features of the systems and methods disclosed herein will become more readily apparent to those having ordinary skill in the art from the following detailed description of certain embodiments taken in conjunction with the drawings which set forth representative embodiments of the present invention. Like reference numerals are used herein to denote like parts. Further, words denoting orientation such as "upper," "lower," "distal," and "proximate" are merely used to help describe the location of components with respect to one another. For example, an "upper" surface of a part is merely meant to describe a surface that is separate from the "lower" surface of that same part. No words denoting orientation are used to describe an absolute orientation, i.e., where an "upper" part must always be on top.

Referring now to FIG. 1, a perspective view of a mounted wall hung toilet system 100 is shown. A connector 102 is mounted within the interior 104 of a support structure or wall 106, such as a wall of a bathroom. Four supports screws 108 extend through the wall 106, coupling a wall hung toilet 101 to the connector 102. A cylindrical waste pipe 110 extends from the toilet bowl 112 into a cylindrical aperture 114 within a flange 116 of the connector 102. The connector 102 has a planar plate 103 with the flange 116 extending therefrom. The planar plate 103 has a plurality of mounting holes 105 for attaching to the wall structure 106. A gasket 118 helps seal the waste pipe 110 to the connector 102, as discussed in more detail below. The waste pipe 110 is coupled to a pipe chase 120 which directs wastewater through a drain pipe (not distinctly shown) and out of the system 100, e.g., into a public wastewater system, after the toilet 101 is flushed.

Figure 2:
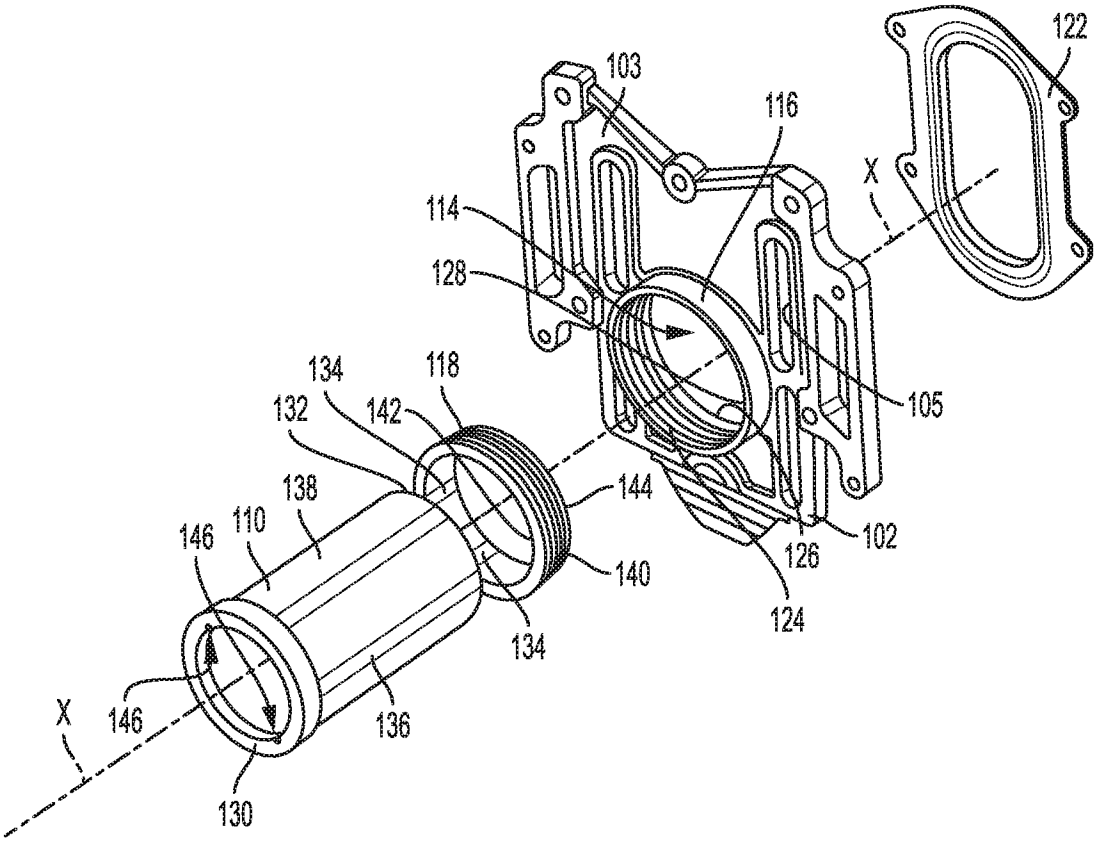
FIG. 2 is an exploded perspective view of components for a wall hung toilet system in accordance with the subject technology.

Turning to FIG. 2, an exploded view showing various components for mounting a wall hung toilet (not shown) in accordance with the subject technology are shown. The cylindrical aperture 114 created by the flange 116 of the connector 102 is arranged around a central axis "x." The flange 116 has a threaded interior surface 124 which slopes toward the central axis from a proximate wide side 128 to a distal narrow side 126. The cylindrical waste pipe 110 is elongated along the central axis X, the waste pipe 110 having a first open end 130 configured to form a fluid connection with the toilet. A second open end 132 of the waste pipe 110 is configured to be sealed within the flange 116 via a ring-shaped gasket 118. A chase gasket 122 is also included, which can help seal the connector 102 to the pipe chase 120.

Figure 3:
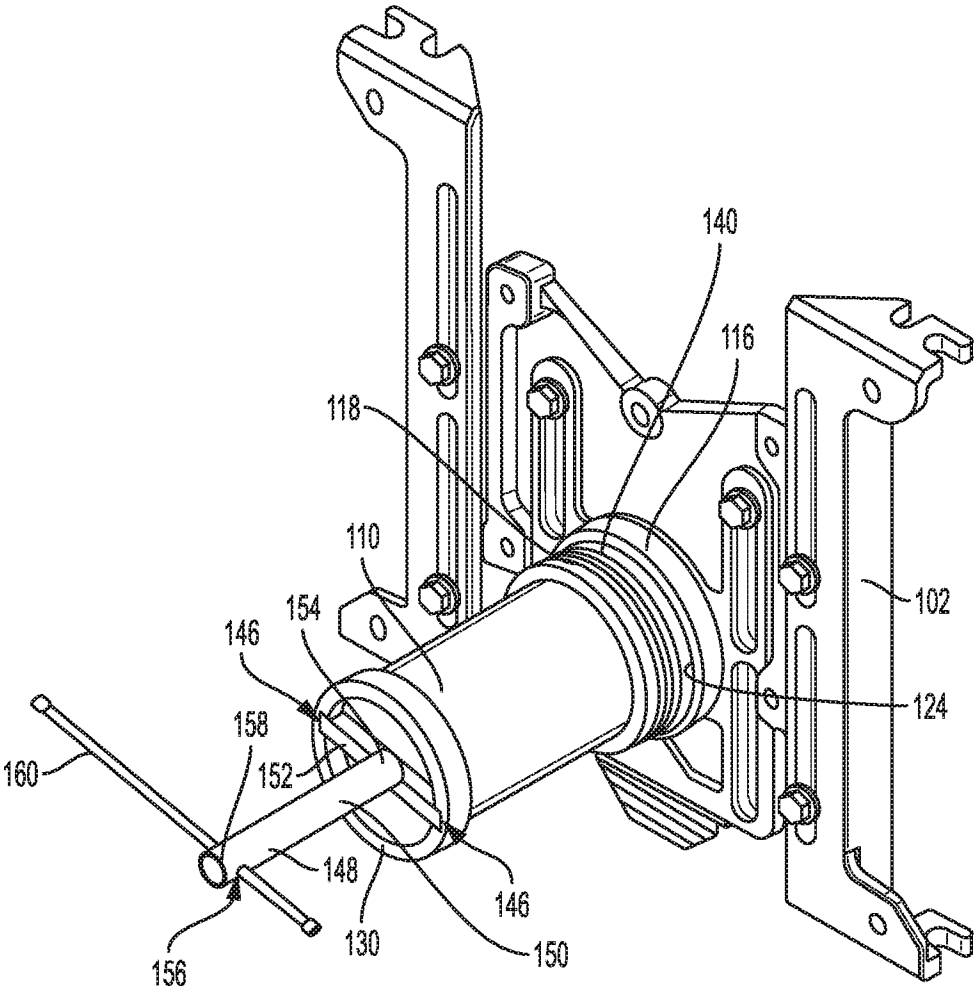
FIG. 3 is a perspective view of components for a wall hung toilet system being assembled in accordance with the subject technology.

The ring-shaped gasket 118 includes a plurality of interior axial voids 134 which correspond to, and are configured to receive, spaced axial ribs 136 extending from the exterior surface 138 of the waste pipe 110. While the exterior ribs 136 are shown running almost the entire length of the waste pipe 110, the ribs 136, in one example, need only be provided adjacent to the second open end 132 of the waste pipe 110 such that the ribs 136 can couple with the gasket 118. When the ribs 136 and voids 134 are coupled, the ribs 136 prevent the gasket 118 from rotating with respect to the waste pipe 110. That is to say, rotation of the gasket 118 around the central axis X forces a corresponding rotation of the waste pipe 110, e.g., as shown in FIG. 3 and described below.

The gasket 118 also includes a threaded exterior surface 140 which slopes from a proximate wide end 142 to a distal narrow end 144. In this way, the slope of the exterior 140 of the gasket 118 corresponds to the slope of the interior 124 of the flange 116, i.e., the components slope in the same direction at a similar angle, although the slope is not necessarily identical. The wide side 128 of the flange 116 extends from the connector 102 toward where the toilet 101 will be positioned, while the narrow side 126 is deeper within the support structure 106. This allows the wide side 128 of the flange 116 to easily receive the narrow end 144 of the gasket 118. After the narrow end 144 of the gasket 118 is positioned within the wide side 128 of the flange, rotation of the waste pipe 110 causes the exterior threaded surface 140 of the gasket 118 to engage with the interior threaded surface 124 of the flange 116 within the connector 102.

As the waste pipe 110 is rotated more, the narrow end 144 of the gasket 118 is pressed deeper into the threaded interior 124 of the flange 116, causing further engagement between the threaded surfaces 124, 140. In this way, rotation pushes the gasket 118 toward the narrow end 126 of the flange connector 102, tightening the seal between the gasket 118 and the connector 102 to provide a strong and effective seal for transmission of wastewater between the toilet 101 and the pipe chase 120. Additionally, the rotation causes the connector 102 to press the gasket 118 toward the central axis X and the waste pipe 110, sealing the gasket 118 against the waste pipe 110 to create a strong seal. Thus, a tight seal is effectively provided between the waste pipe 110 and the connector 102, both of which are sealed to the gasket 118. Notably, while the flange 116 is shown in FIG. 2 to provide a larger engagement surface between the gasket 118 and the connector 102, in some embodiments the flange 116 may simply be the area of the connector 102 forming the aperture 114. That is, the flange 116 need not extend from the connector 102 in all embodiments.

In some cases, one or more ring inserts (not shown) can be included in or near the interior voids 134 of the gasket 118 to structurally reinforce the voids 134 and prevent deformation during rotation. The insert(s) can be of a first material of a higher durometer than the material of the gasket 118, the first material being less susceptible to flexing and/or deformation. For example, the insert can be a metal material while the gasket 118 is a plastic. The insert can run directly across the entire interior surface of the gasket 118 (and within the voids 134) or several inserts can be placed along the interior surface of the gasket 118 in or around the voids 134. Alternatively, one or more inserts can be integrated into the gasket 118, rather than just on the interior surface.

Referring now to FIG. 3, the waste pipe 110, gasket 118, and connector 102 are shown in the process of being coupled together to form a seal. The first end 130 of the waste pipe 110 includes two opposing gaps 146 (see also FIG. 2) which allow for the waste pipe 110 to be rotated by a tool 148. For example, a carrier nipple tool 148, or a similar tool as are known in the art, can be used to rotate the waste pipe 110 and gasket 118, sealing the waste pipe 110 to the connector 102, e.g., via the connector flange 116, as described above. The carrier nipple tool 148 includes a central bar 150 forming a "T" with a perpendicular fixed member 152 attached at a distal end 154. The carrier nipple tool 148 also has a transverse hole 156 at a proximate end 158 within which a slidable member 160 resides. The fixed member 152 can be inserted into the gaps 146 in the perimeter of the open end 130 of the waste pipe 110 to extend across the open face of the waste pipe 110. The slidable member 160 can then be gripped by the user to rotate the carrier nipple tool 148, and therefore the waste pipe 110. Rotation of the waste pipe 110 correspondingly causes rotation of the gasket 118, forcing the gasket 118 deeper into the flange 116 of the connector 102 as the threaded exterior surface 140 of the gasket 118 engages the threaded interior surface 124 of the flange 116. This rotation results in the gasket 118 more firmly sealing to the connector 102 as described above. Further, the gasket 118 can be tightened to the flange 116 with the carrier nipple tool 148 using only a rotational force, in one example, rather than a longitudinal force. This allows the carrier nipple tool 148 to be easily removed from the waste pipe 110 by pulling in the longitudinal direction, i.e., along the central axis X, away from the connector 102 once a firm seal is in place.

Figure 4A:
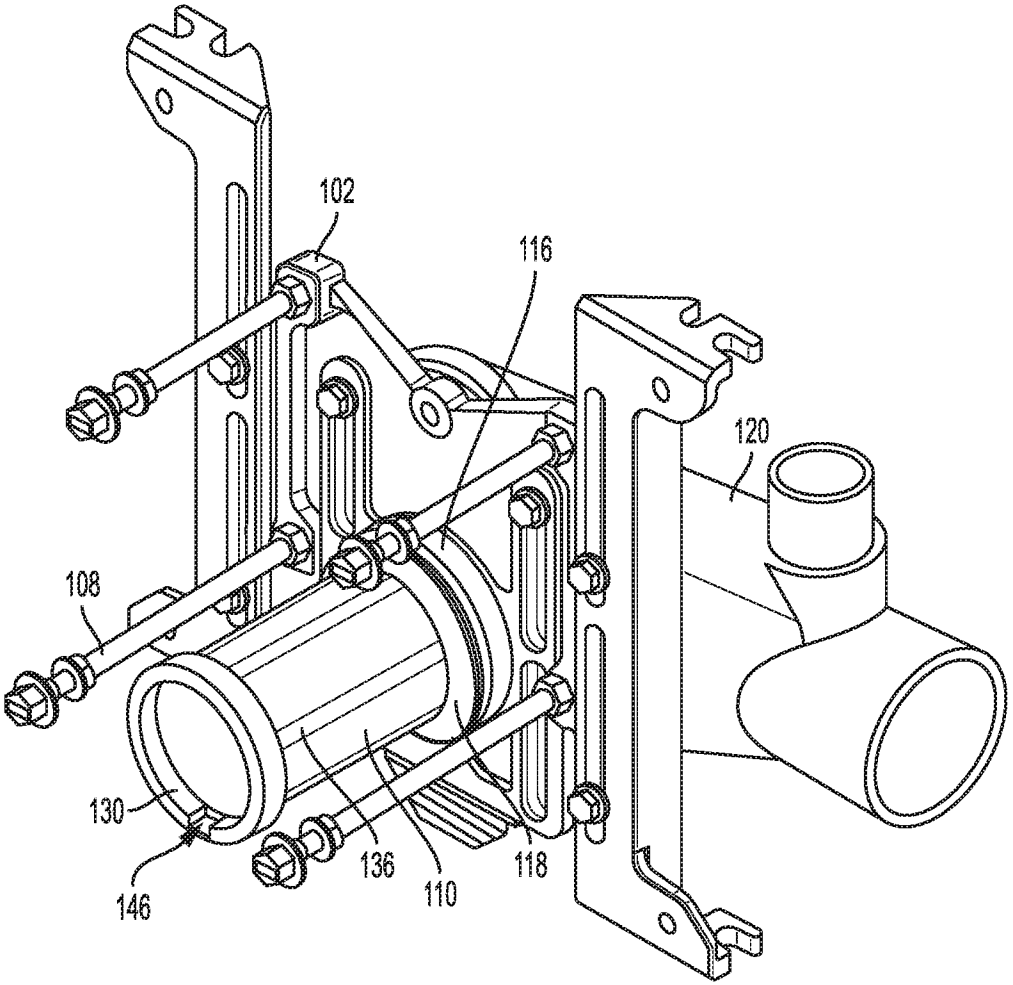
FIG. 4A is a perspective view of assembled components for a wall hung toilet system in accordance with the subject technology.
Figure 4B:
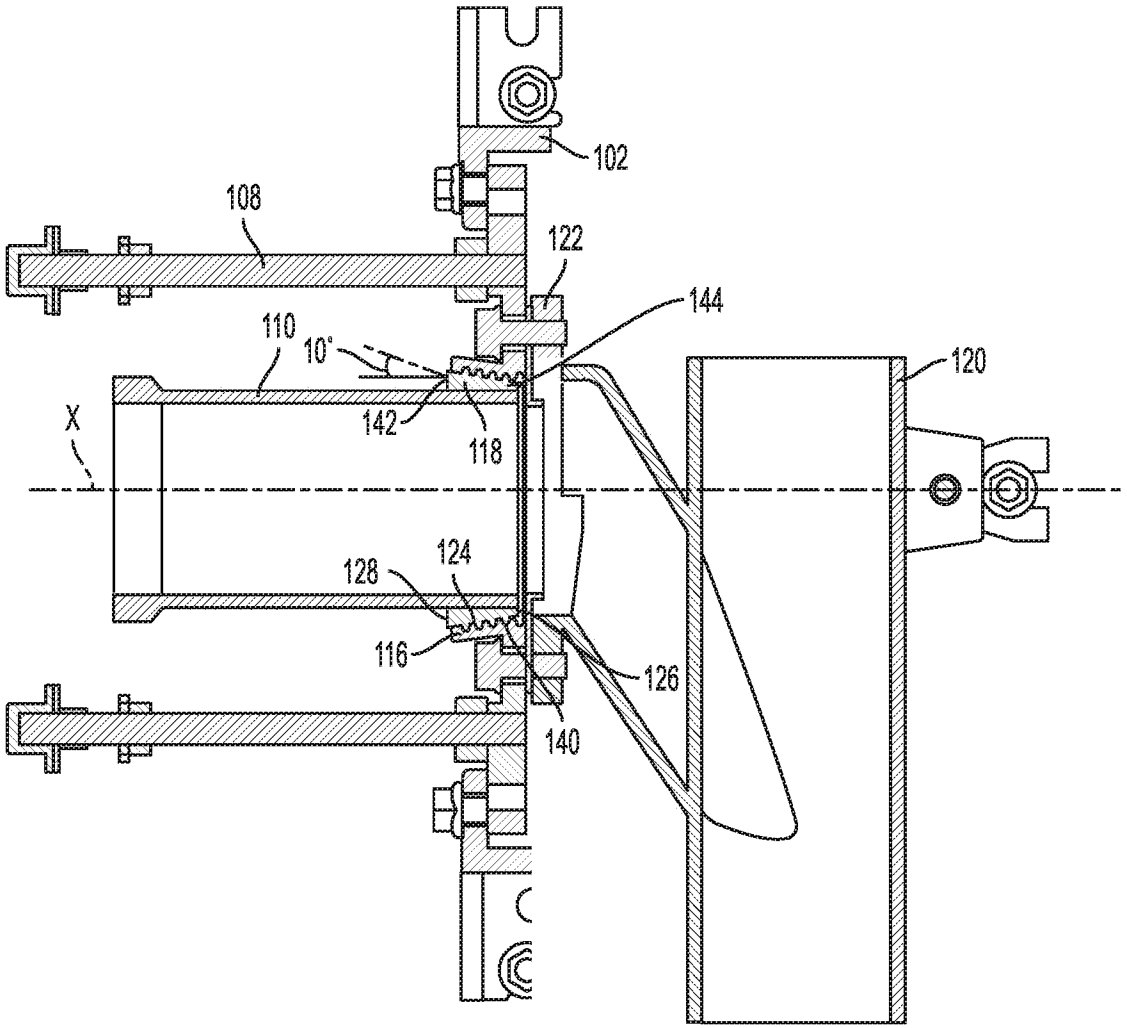
FIG. 4B is a horizontally sliced cross section of a portion of the wall hung toilet system of FIG. 4A.
Figure 4C:
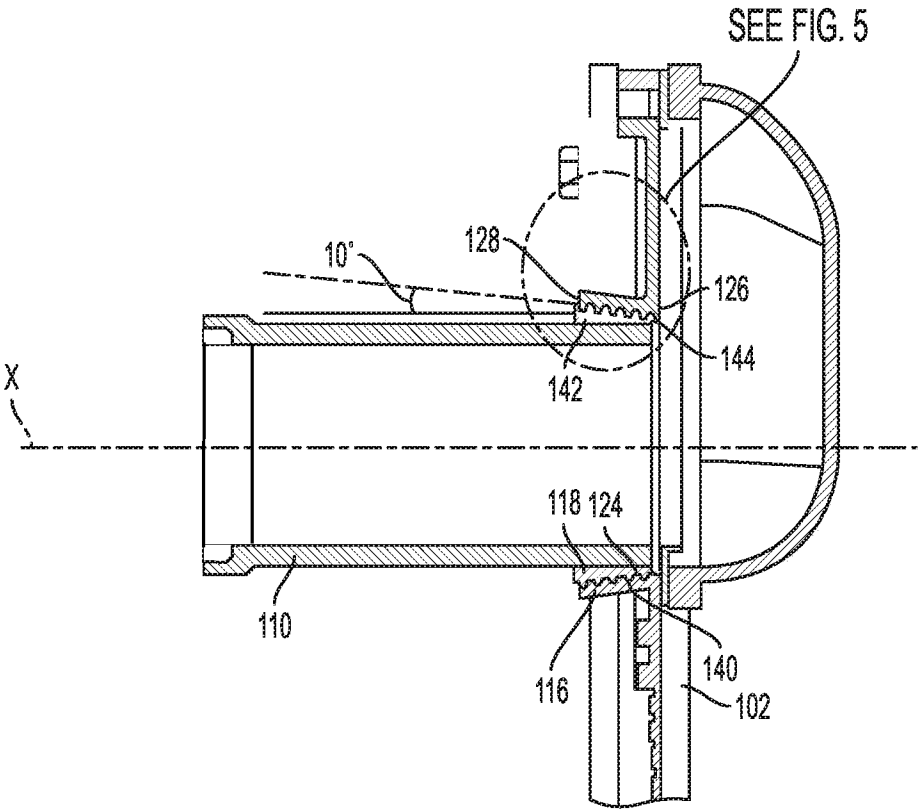
FIG. 4C is a vertically sliced cross section of a portion of the wall hung toilet system of FIG. 4A.
Figure 5:
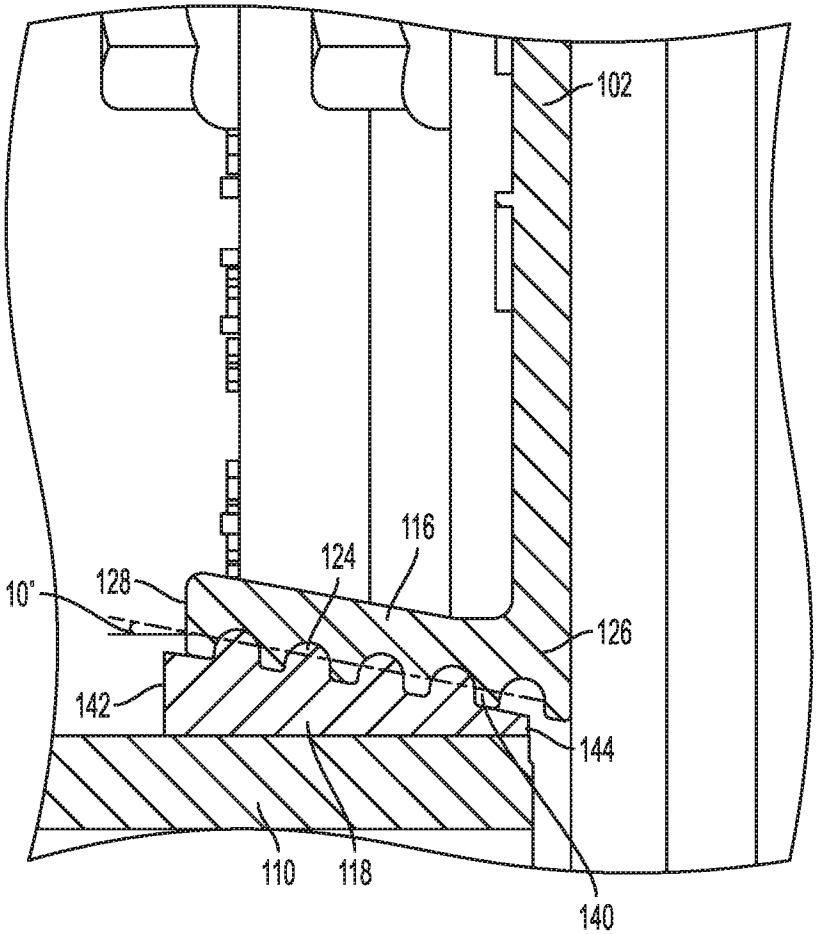
FIG. 5 is a zoomed in view of the seal formed between the gasket and flange as shown in FIG. 4C.

Referring now to FIGS. 4A-4C and 5, the components of the system 100 are shown with the waste pipe 110 fully sealed to the connector 102 via the gasket 118. FIG. 4A shows components of the sealed toilet system 100 in perspective. FIG. 4B is a horizontally sliced cross section of a portion of FIG. 4A while FIG. 4C is a vertically sliced cross section of a portion of FIG. 4A. FIG. 5 is a zoomed in view of the seal formed between the gasket 118 and the flange 116, as referenced in FIG. 4C.

Still referring to FIGS. 4A-4C and 5, as described with respect to FIG. 3, the waste pipe 110 has been screwed in, thus forcing the external threads 140 of the gasket 118 deeper into the internal threads 124 of the flange 116 until a tight and secure seal is formed. The seal tightens more effectively as a result of the slope of the threads 124, 140. In the example shown, the threaded exterior 140 of the gasket 118 slopes toward the central axis X, from a wide end 142 to a narrow end 144, at a slope of about 10°. The threaded interior 140 of the flange 116 likewise slopes toward the central axis X from the wide side 128 to the narrow side 126, at about 10°. This allows the wide side 128 of the flange 116 to easily receive the smaller narrow side 126 of the gasket 118, while a tight seal is still provided as the sloped threads 124, 140 couple together more deeply. Other slopes have also been found to be effective, including slopes of between 5-15 degrees. Further, the wide end 142 of the gasket 118 has a larger outer diameter than the inner diameter of the narrow side 126 of the flange 116. As a result, tightening the seal between the gasket 118 and the flange 116 will never cause the gasket 118 to pass entirely through the connector 102.

It will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements shown as distinct for purposes of illustration may be incorporated within other functional elements in a particular implementation.

While the subject technology has been described with respect to various embodiments, those skilled in the art will readily appreciate that various changes and/or modifications can be made to the subject technology without departing from the scope of the subject technology.

What is claimed is:

1. A toilet system, comprising:

a connector configured for fixation to a support structure, the connector defining a cylindrical aperture around a central axis, the cylindrical aperture having a threaded interior surface;

a cylindrical waste pipe elongated along the central axis and having a plurality of spaced ribs extending from an exterior surface; and a ring-shaped gasket positioned around the central axis and having:

a plurality of interior voids each corresponding to, and configured to, receive one of the spaced ribs; and a threaded exterior surface configured for engagement with the threaded interior surface of the connector, wherein the threaded exterior surface is sloping toward the central axis.

2. The toilet system of claim 1, wherein the threaded exterior surface slopes toward the central axis at an angle of about 10°.

3. The toilet system of claim 1, wherein the threaded exterior surface slopes toward the central axis at an angle of between 5° and 15°.

4. The toilet system of claim 1, further comprising a pipe chase configured for attachment to the connector around the cylindrical aperture.

5. The toilet system of claim 4, further comprising a chase gasket configured to couple the pipe chase to the connector.

6. The toilet system of claim 1, further comprising a plurality of screws configured to attached to the connector around the cylindrical aperture.

7. The toilet system of claim 1, wherein the ring-shaped gasket is of a first material of a first durometer, the ring-shaped gasket including a ring insert structurally reinforcing the interior voids, the ring insert being of a second material of a higher durometer than the first material.

8. The toilet system of claim 1, wherein:

the cylindrical waste pipe is elongated along the central axis and further comprises:

a first open end configured to form a fluid connection with a toilet; and a second open end.

9. The toilet system of claim 1, wherein the connector includes a flange, the cylindrical aperture being defined by the flange and the threaded interior surface forming an interior surface of the flange.

10. The toilet system of claim 9, wherein the threaded interior surface slopes toward the central axis from a wide side of the flange to a narrow side of the flange.

11. The toilet system of claim 10, wherein the threaded exterior surface of the ring-shaped gasket slopes from a wide end of the ring-shaped gasket to a narrow end of the ring-shaped gasket.

12. The toilet system of claim 11, wherein:

the narrow end of the ring-shaped gasket has a smaller outer diameter than an inner diameter of the wide side of the flange; and the wide end of the ring-shaped gasket has a larger outer diameter than an inner diameter of the narrow side of the flange, thereby preventing the ring-shaped gasket from passing entirely through the connector.

13. The toilet system of claim 1, wherein the cylindrical waste pipe further comprises:

at least two gaps positioned along an interior diameter of the waste pipe, each gap opposite a respective opposing gap at an opposite position along the interior diameter, wherein each gap is configured to receive a fixed member of a carrier nipple tool to facilitate rotation of the cylindrical waste pipe.

14. The toilet system of claim 13, wherein the cylindrical waste pipe includes exactly two opposing gaps.

15. A toilet system, comprising:

a connector configured for fixation to a support structure, the connector including a flange defining a cylindrical aperture with a threaded interior surface around a central axis, the threaded interior surface sloping toward the central axis from a wide side of the flange to a narrow side of the flange;

a cylindrical waste pipe elongated along the central axis and having a first open end configured to form a fluid connection with a toilet and a second open end, a plurality of spaced ribs extending from an exterior surface of the waste pipe adjacent to the second open end; and a ring-shaped gasket positioned around the central axis and having:

a plurality of interior voids each corresponding to and configured to receive one of the spaced ribs, engagement between the spaced ribs and interior voids forcing the ring-shaped gasket to rotate around the central axis in response to rotation of the waste pipe around the central axis; and a threaded exterior surface configured for engagement with the threaded interior surface of the flange, the threaded exterior surface sloping toward the central axis from a wide end of the ring-shaped gasket to a narrow end of the ring-shaped gasket, wherein when the narrow end of the ring-shaped gasket is positioned within the wide side of the connector, rotation of the ring-shaped gasket around the central axis tightens a seal formed between the threaded interior surface of the aperture and the threaded exterior surface of the ring-shaped gasket.

16. The toilet system of claim 15, wherein the threaded exterior surface slopes toward the central axis at an angle of between 5° and 15°.

17. The toilet system of claim 15, wherein the ring-shaped gasket is of a first material of a first durometer, the ring-shaped gasket including a ring insert structurally reinforcing the interior voids, the ring insert being of a second material of a higher durometer than the first material.

18. The toilet system of claim 15, wherein:

the narrow end of the ring-shaped gasket has a smaller outer diameter than an inner diameter of the wide side of the flange; and the wide end of the ring-shaped gasket has a larger outer diameter than an inner diameter of the narrow side of the flange, thereby preventing the ring-shaped gasket from passing entirely through the connector.

19. The toilet system of claim 15, wherein the cylindrical waste pipe further comprises:

at least two gaps positioned along an interior diameter of the waste pipe, each gap opposite a respective opposing gap at an opposite position along the interior diameter, wherein each gap is configured to receive a fixed member of a carrier nipple tool to facilitate rotation of the cylindrical waste pipe.

* * * * *